US005791571A

United States Patent [19]

Hijikata

[11] Patent Number: 5,791,571

[45] Date of Patent: Aug. 11, 1998

[54] CAST SAND AERATION APPARATUS

[75] Inventor: Taiichi Hijikata, Toyokawa, Japan

[73] Assignee: Sintokogio, Ltd., Nagoya, Japan

[21] Appl. No.: 688,705

[22] Filed: Jul. 31, 1996

[30] Foreign Application Priority Data

Aug. 11, 1995 [JP] Japan ..... 7-227497

[51] Int. Cl.[6] ..... B02C 13/28

[52] U.S. Cl. ..... 241/188.2; 164/412; 241/275; 241/DIG. 10

[58] Field of Search ..... 241/275, 188.1, 241/188.2, DIG. 10; 164/412

[56] References Cited

U.S. PATENT DOCUMENTS 2,928,616 3/1960 Smith ..... 241/275
4,113,191 9/1978 Wattles et al. ..... 241/275

*Primary Examiner*—Mark Rosenbaum
*Attorney, Agent, or Firm*—Limbach Limbach L.L.P.

[57] ABSTRACT

A cast sand aeration apparatus is provided that is equipped with rotating pins with reduced wear. The apparatus consists of rod-like rotating pins, each of which is vertically cut out along a plane h offset toward the direction of rotation by 15–25 degrees relative to the axis of the rotating shaft so as to form a rod-like pin with a flat portion.

1 Claim, 1 Drawing Sheet

CAST SAND AERATION APPARATUS

TECHNICAL FIELD

This invention relates to an apparatus for aerating kneaded cast sand, kneaded by using a roller-type kneading machine or the like, used for a greensand mold, to loosen lumps of the cast sand.

BACKGROUND OF THE INVENTION

One of the conventional apparatuses, used as the above-mentioned cast sand aeration apparatus, comprises many rod-like stationary pins hung from lower peripheries of a stationary cylindrical body with proper intervals therebetween, a high-speed rotating vertical shaft disposed under the center part of the cylindrical body, a fitting circular plate, whose diameter is slightly less than the inside diameter of a circle formed by the rod-like stationary pins, mounted on the vertical shaft, and many rod-like rotating pins upwardly extending from the periphery of the fitting circular plate, the upper ends of which rotating pins extend to the upper parts of the stationary pins.

The cast sand aeration apparatus with the above structure has problems in that since the high-speed rotating pins repeatedly and violently collide with the thrown cast sand, certain parts of the pins wear greatly, so that they shortly become useless, i.e. in a month or so. This invention is devised considering the above problems so as to provide a cast sand aeration apparatus that can reduce the wear of the rotating pins.

To solve the above problem the inventor observed in detail the conditions under which rotating pins are exposed. As a result, it was found that they greatly wear away centering around positions offset toward their direction of rotation by about 20 degrees relative to the axis of the high-speed vertical shaft. It was also found that during a continued aeration process, cast sand violently collides with the pins at those offset positions, so that the sand repeatedly adheres to the rotating pins in a mountain-like shape and repeatedly comes off. Based on the above observations, various kinds of experiments were devised and carried out, assuming that if the cast sand that adheres to the rotating pins is prevented from coming off, the wear of the rotating pins can be greatly reduced. As a result, this invention was achieved.

SUMMARY OF THE INVENTION

To achieve the above purpose the cast sand aeration apparatus of this invention, comprising many rod-like stationary pins hung from the lower periphery of a stationary cylindrical body with proper intervals therebetween, a high-speed rotating vertical shaft disposed under the center part of the cylindrical body, a fitting circular plate, whose diameter is slightly less than the inside diameter of a circle formed by many rod-like stationary pins, mounted on the vertical shaft, and many rod-like rotating pins upwardly extending from the periphery of the fitting circular plate, the upper ends of which rotating pins extend to upper parts of the stationary pins, is characterized in that each rotating pin is vertically cut out along a plane h centered around a point offset toward the direction of rotation by 15–25 degrees relative to the vertical shaft, so as to form a rod-like pin with a flat portion.

EMBODIMENTS

Figure 1:
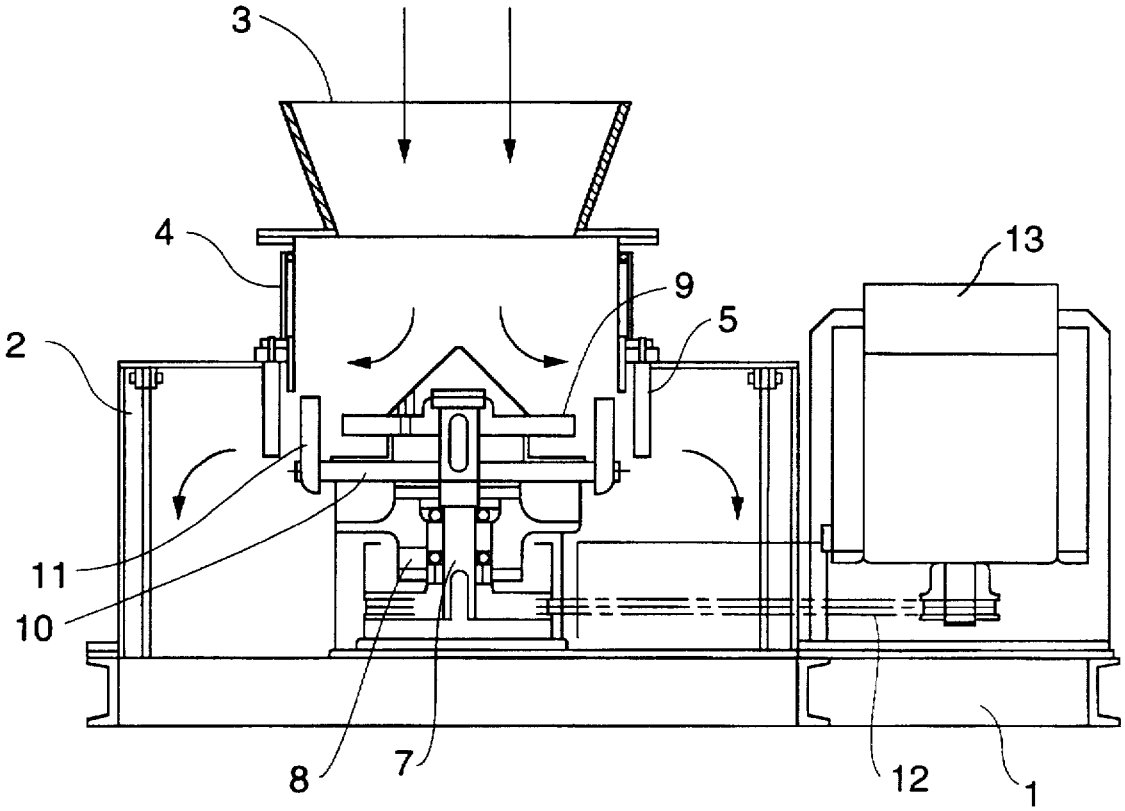
FIG. 1 is a cross-sectional front view of an embodiment of the invention.
Figure 2:
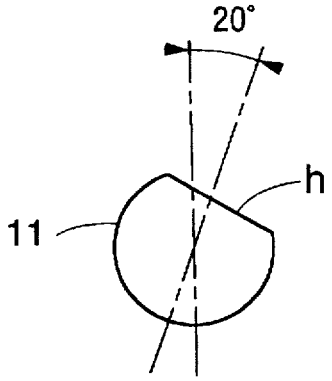
FIG. 2 is an enlarged plan view of one of pins 11 of FIG. 1.

An embodiment of this invention will now be described based on the drawings. A gate-shaped frame 2 is mounted on a base stand 1. The lower peripheral ends of a cylindrical body 4, on the upper part of which body 4 is mounted a throwing chute 3, are fixedly supported on the top part of the frame 2. Many rod-like stationary pins 5 are hung from the peripheral ends of the cylindrical body 4. A high-speed vertical shaft 7 is rotatably disposed at a position on the base stand 1 corresponding to the center of the cylindrical body 4. A dispersion blade 9, for dispersing the cast sand, thrown into the body 4 toward the peripheries, is mounted on the upper end of the vertical shaft 7. A fitting circular plate 10, whose diameter is slightly less than the inside diameter of a circle formed by many stationary pins 5, is fixed on the vertical shaft 7 at a position under the dispersion blade 9. Many rod-like rotating pins 11 each with a flat portion, the upper ends of which pins extend to the upper position of the stationary pins 5, upwardly extend from the periphery of the circular plate 10.

The rod-like rotating pins 11, each with a flat portion, are manufactured such that a rod-like body is vertically cut out so as to form a plane h centered around a position which is offset toward the direction of rotation of the rotating pins 11 by about 20 degrees relative to the axis of the vertical shaft 7. The high-speed rotating vertical shaft 7 is engagedly connected via a transmission mechanism such as a belt pulley or V-shaped belt to a motor 13 so that it rotates counterclockwise when viewed from above (plan). Although each plane h of the rod-like rotating pins 11 is formed so as to be centered around a position which is offset toward the direction of rotation of the rotating pins 11 by about 20 degrees relative to the axis of the vertical shaft 7, the plane h may be shifted by a range between plus or minus 5 degrees, in accord with the speed of the rotating pins 11.

The thus-structured apparatus operates as follows: the motor 13 is driven so as to rotate the vertical shaft 7 along with the dispersion blade 9 and the rotating pins 11 at a high speed. Kneaded cast sand is continuously thrown from the chute 3 by a belt conveyor or the like. The falling kneaded sand is cut and dispersed outwardly by the dispersion blade 9. The cut and dispersed sand is aerated between the rotating pins 11 and stationary pins 5 through collisions with them, to fall. During this operation most of the kneaded cast sand, which has collided with the rotating pins 11, collides with the flat part of the plane h so as to adhere thereto in a mountain-like shape. When too much sand adheres, the sand at the top of the mountain-like shape is repeatedly scraped away by successive kneaded cast sand, without all the adhered sand coming off. Thus, the rotating pins 11 can aerate kneaded cast sand without generating substantial wear where the parts collide.

As is clear from the above descriptions, the rod-like rotating pins of the cast sand aeration apparatus are vertically cut out along a plane h offset toward the direction of rotation by 15–25 degrees relative to the axis of rotation of the shaft, so as to form rod-like pins, each with a flat portion. Thus the apparatus has a great advantage in that since kneaded cast sand strongly adheres to the flat parts that collide so that it hardly comes off, the adhered sand can prevent the pins wearing at the parts where the sand collides with the pins.

What is claimed is:

1. An apparatus for aerating cast sand, comprising:

a stationary cylindrical body having a periphery and a center, stationary pins extending downward from the periphery of the stationary cylindrical body with proper intervals therebetween so as to define an annulus having an inner diameter, a high-speed rotating vertical shaft disposed under the center of the cylindrical body and having a direction of rotation, a circular plate whose diameter is slightly less than the inner diameter of the annulus, mounted on the vertical shaft so as to rotate with the vertical shaft in the direction of rotation and having a plate center and a periphery, and a plurality of pins extending upward from the periphery of the circular plate such that upper ends of the pins extend to upper parts of the stationary pins, wherein each of said pins has a cross-section with a partially circular portion centered about a pin center and a flat portion, the flat portion being oriented perpendicular to a plane offset from a vertical radial plane by 15–25 degrees toward the direction of rotation, said vertical radial plane containing the plate center and the pin center.

* * * * *